United States Patent [19]

Sandoz et al.

[11] 4,134,119

[45] Jan. 9, 1979

[54] ANTENNA TEST SHIELD

[75] Inventors: Oscar A. Sandoz, Ottawa; Keith E. Hooey, Kanata, both of Canada

[73] Assignee: The Secretary of State for Defence in Her Britannic Majesty's Government of the United Kingdom of Great Britain and Northern Ireland, Ottawa, Canada

[21] Appl. No.: 809,155

[22] Filed: Jun. 23, 1977

[51] Int. Cl.[2] ..... H01Q 1/28

[52] U.S. Cl. ..... 343/703; 343/705

[58] Field of Search ..... 343/703, 872, 705

[56] References Cited

U.S. PATENT DOCUMENTS

| | | | |
|---|---|---|---|
| 2,490,782 | 12/1949 | Collup | 343/703 |
| 3,286,264 | 11/1966 | Miley | 343/703 |
| 3,442,476 | 5/1969 | Trimble | 343/872 |
| 3,540,056 | 11/1970 | Cribb | 343/703 |

*Primary Examiner*—Eli Lieberman

*Attorney, Agent, or Firm*—Michael M. Sakovich

[57] ABSTRACT

Apparatus for transferring electromagnetic signal energy between a signal circuit and an antenna that extends outwardly from a ground-plane surface includes a conductive shield that substantially encloses the antenna to confine the signal energy and to exclude all others. The shield has an open end to admit the antenna and suction-cup means disposed around the opening to mechanically connect the apparatus to the surface. A plug of dielectric material inside the open end includes a through passage and a recessed portion that conforms to a base of the antenna and operates to align the antenna within the shield. Conductive mesh lines the recessed portion and is electrically connected to the shield. Flexible contacts extend inwardly from the shield and engage mounting screws in the antenna base to electrically connect the shield to the surface. A conductive sleeve is mounted on the free end of the plug in coaxial, energy transfer relation with a longitudinal portion of the antenna and is electrically connected to a feed-through connector on the shield for connection to the signal circuit.

12 Claims, 4 Drawing Figures

ANTENNA TEST SHIELD

BACKGROUND OF THE INVENTION

This invention relates to signal coupling apparatus and more particularly to antenna signal coupling apparatus which is shielded to confine a predetermined signal and to exclude all other signals.

In general, a complete radio system includes apparatus for transmitting an output signal in the form of electromagnetic energy, and receiving apparatus for capturing a portion of the transmitted electromagnetic energy and processing the energy to reproduce the original signal. A structural member that is found in both the transmitter and receiver of the system is a transmitting antenna for emitting electromagnetic energy, and a receiving antenna that is suitably matched to the characteristics of the radiated electromagnetic energy to capture a usable portion thereof.

An inevitable requirement of the radio system is eventual repair and adjustment. Moreover, the system requires periodic tests to determine if its performance ratings are achieved. The significance of maintenance and performance tests is of considerable importance in applications where the radio system is used as a navigation aid. It is even more important to be aware of the operating characteristics of the radio system if it is used primarily in emergency applications. In this regard, the transmitter may be an Emergency Locater Transmitter (ELT) of a type used aboard aircraft. Since the ELT is relied upon to transmit a distress signal for a downed aircraft, it is imperative that the quantitative and qualitative characteristics of the signal be known. Similarly, in the case of radio receiving apparatus used in search and rescue operations, the receiving characteristics of the equipment must be known if search patterns are to be conducted effectively.

Known VHF receivers in search and rescue aircraft, operating on 121.5 MHz., can detect and home in on an ELT at close to line-of-sight limits. In view of the normal operational altitudes of such aircraft, these limits can be well in excess of 100 nautical miles. It is apparent, therefore, that a most important consideration in maintaining optimum conditions in search and rescue operations resides in providing that all components of the VHF homing system are functioning properly. In particular, it must be ascertained that the receiver meets its sensitivity specification, that the amplifier, detector, indicator and phasing network that comprise a switched-cardioid homing system are performing as they should, and that no faults exist in the antenna elements and associated feedlines.

During periodic maintenance and performance tests, the equipment is removed from the aircraft and is bench-tested in a workshop environment. Such testing is very time consuming since it involves removal and reinstallation of the equipment and furthermore does not cover all components of the system and their interfacing elements. Accordingly, a serious flaw occurs in the bench-testing procedure, i.e., that while the tested components may work satisfactorily in the workshop, there is no guarantee that the system will perform according to rated specifications after reinstallation. Moreover, it is possible that malfunctions may even be introduced after the testing procedure because of a faulty reinstallation. A search crew may therefore engage in a mission under the false apprehension that their electronic gear capability is neither reduced nor destroyed by defective equipment.

Since the object of search and rescue operations is to save human lives, which object may be defeated by the known deficiencies in pre-flight testing of radio gear, there is an obvious requirement for a simple pre-flight diagnostic procedure and apparatus to rapidly check the overall aircraft homing system in situ while the aircraft is in the hangar or on the tarmac. If a fault is found, repairs or replacment can be made immediately and the equipment immediately retested or an alternate aircraft can be put into service. Moreover, since in search and rescue time is frequently of the essence, if only moderate degradation of system performance is found, it is possible that the aircraft would still be flown but with modified search tactics, such as reduced track spacing, in order to compensate for the reduced capabilities of the homing system.

SUMMARY OF THE INVENTION

The present invention provides an antenna coupler apparatus that is usable with known signal generating and receiving equipments for testing the radio system in situ.

The antenna coupler of the invention also provides that signal losses between an antenna under test and a predetermined electrical circuit are highly repeatable in order to maximize the reliability of the test procedure.

The antenna coupler of the invention still further provides sufficient electromagnetic shielding to ensure that external noise does not dominate the internal system noise to degrade a sensitivity test.

The invention still further provides that the antenna coupler confines a predetermined signal fed thereto.

The aforenoted problems may be substantially overcome and the provisions of the invention achieved by recourse to the invention which is a shielded signal coupler for transferring electromagnetic energy between a signal circuit and an antenna that is upstanding from a ground-plane surface. The signal coupler includes shield means having electrically conductive walls that define a closed chamber which includes end portions defining a first opening adapted to admit the antenna. Means are provided for electrically connecting the walls adjacent the first opening with the surface. Coupling means are provided within the chamber in isolated relation with the walls and antenna and in coaxial, energy transferring relation with the antenna. Signal conduction means in the coupler communicate the energy between the circuit and the coupling means through a second opening in the walls.

DESCRIPTION OF THE DRAWINGS

The invention will now be more particularly described with reference to an embodiment thereof shown, by way of example, in the accompanying drawings wherein.

DESCRIPTION OF THE ILLUSTRATED EMBODIMENT

Figure 4:
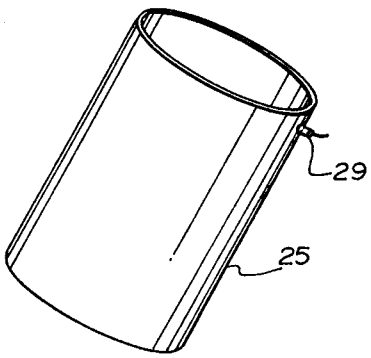
FIG. 4 is a perspective view of a conductive sleeve disposed within the apparatus of FIG. 1.
Figure 1:
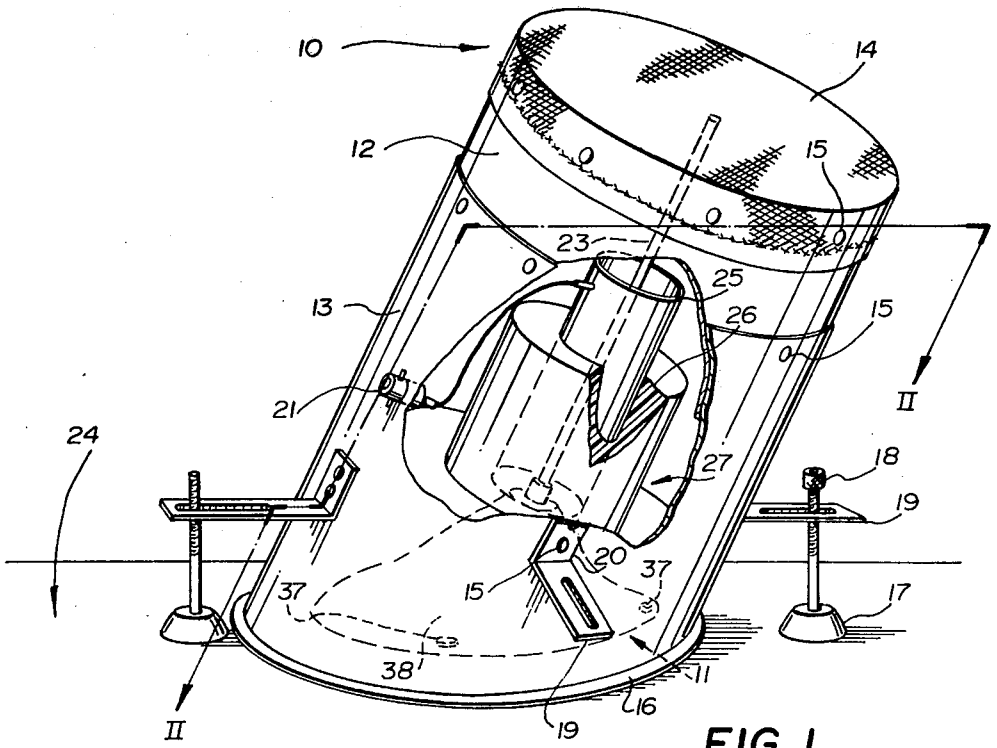
FIG. 1 is a perspective view of a signal coupler apparatus in accordance with the invention.

FIG. 1 illustrates a perspective view of a shielded signal coupler 10 with portions broken away to indicate components inside. Furthermore, a quarter-wave, monopole VHF homing antenna 11 is shown in broken line form to indicate its location within the coupler 10. The complete assembly of the coupler 10 is readily apparent in FIG. 2 which is a longitudinal sectional view taken along the lines II—II of FIG. 1. The antenna 11 is partly shown in a broken line form to indicate its location. It will be observed that the coupler 10 comprises three parts, an upper shield assembly that includes an upper cylindrical shield 12 and a metallic screen 14, a lower shield assembly which comprises a lower cylindrical shield 13 and means for mounting the coupler 10 on a surface, and an R.F. coupling means shown as a conductive sleeve 25. A perspective view of the sleeve 25 appears in FIG. 4. It will be observed that the lower shield 13 is upstanding from a mounting surface 24, which is also a ground-plane for the antenna 11, and that both shields are inclined to correspond with an angle of rake to which the antenna is set. The uppermost end of the upper shield 12 is closed by means of a metallic screen 14 that laps over a peripheral portion of the end. And, the end opposite the screened end is adapted to fit snugly into the open uppermost end of the shield 13 where it is secured with rivets 15. The lapped over portion of the screen 14 is secured to the shield 12 with rivets 15 which are spaced uniformly around the periphery of the shield so that the screen completely encloses the antenna 11 for optimized shielding. The lowermost end of the shield 13 is effectively closed off by the surface 24.

The coupler 10 is secured physically to the surface 24 by mounting means that comprise four suction cups 17. Each suction cup 17 has a threaded stud extending outwardly therefrom which holds a correspondingly threaded locknut 18 against a slotted bracket 19 that is fastened to a side wall of the shield 13 adjacent the lowermost end thereof. The end of each bracket 19 that engages the shield 13 has an upturned portion 20 which is fastened to the side of the shield 13 with rivets 15. Only three brackets 19 are shown, the fourth bracket being located behind the coupler 10. Furthermore, only one of the brackets 19 is shown with a complete suction cup assembly. The other brackets 19 are illustrated merely to indicate their relative locations in respect of the shield 13.

When placing the coupler 10 over the antenna 11, the locknuts 18 are initially loose. After the coupler 10 is correctly positioned relative to the antenna, each suction cup 17 is pressed downwardly to engage the surface 24. When each of the four suction cups 17 are thus positioned, each locknut 18 may be threaded onto its stud until a flange 16 contacts the surface 24. It should be noted that the suction cups provide a self adjusting feature to accommodate curvature in the skin of an aircraft. Accordingly, the coupler 10 is not restricted to flat surfaces since the threaded stud portions of the suction cups 17, in connection with the locknuts 18, provide adjustment means to compensate for curvature in the mounting surface.

The coupler 10 has been developed to effectively transfer a test signal to the antenna 11 with repeatable results. The test signal is obtained from a signal generator (not shown) that is similar to an ELT but with added controls to adjust the output amplitude and modulation characteristics. Furthermore, since the antenna array of a homing system usually employs a pair of quarter-wave monopole antennas spaced a quarter-wave length apart, the signal generator must provide two outputs having equal amplitude but differing in phase by 90°. The homing system therefore would require a pair of couplers 10, each of which could be individually mounted on an antenna 11 or, alternatively, two could be ganged together and mounted concurrently over a pair of homing antennas.

The antenna 11 under consideration includes a quarterwave monopole element 23 extending outwardly from a dielectric base 38. A pair of antennas 11 are usually mounted on the bottom of an aircraft carrier and are spaced two feet apart in order to obtain desired homing characteristics.

Each output signal from the signal generator is coupled to a coaxial connector 21 that is mounted in a throughhole on the side of the shield 13 and is fed through to the sleeve 25 inside the coupler 10 to transfer energy from the output circuit of the signal generator to the element 23 of the antenna 11. Connection between the two couplers and the signal generator is preferably made through double shielded coaxial cables which are identical in length in order to preserve phase quadrature.

It has been determined that the sleeve 25 is advantageously constructed as a copper cylinder which is permanently mounted within a recess 26 of a styrofoam plug 27 disposed in the lowermost end of the shield 13. The sleeve 25 is centrally located within the shield 13 and is arranged to be in coaxial alignment with a longitudinal portion of the antenna element 23. The output signal from the generator is coupled through the connector 21 and is conducted along a conductor 28 to a tab 29 extending outwardly from the sleeve 25.

The plug 27 includes a through passage 40 to admit the antenna element 23 inside the shields 12 and 13. Furthermore, a cavity 34 is formed in the lowermost portion of the plug and is shaped to the contours of the base 38 in order to closely fit thereover so as to provide self-centering of the antenna within the coupler 10. An inner copper mesh wall 30 lines the cavity 34 and is electrically connected to the shield 13.

Figure 3:
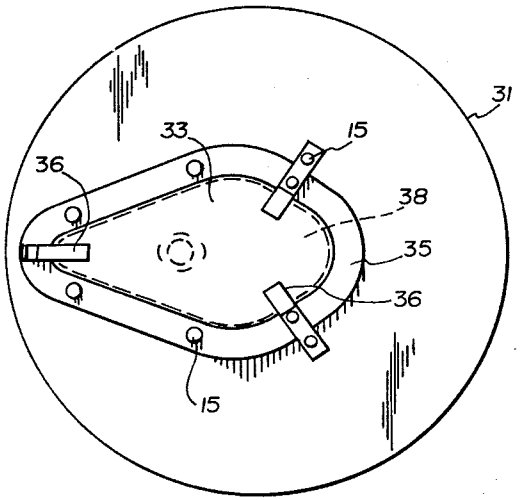
FIG. 3 is a top plan view of the base of the apparatus of FIG. 1.
Figure 2:
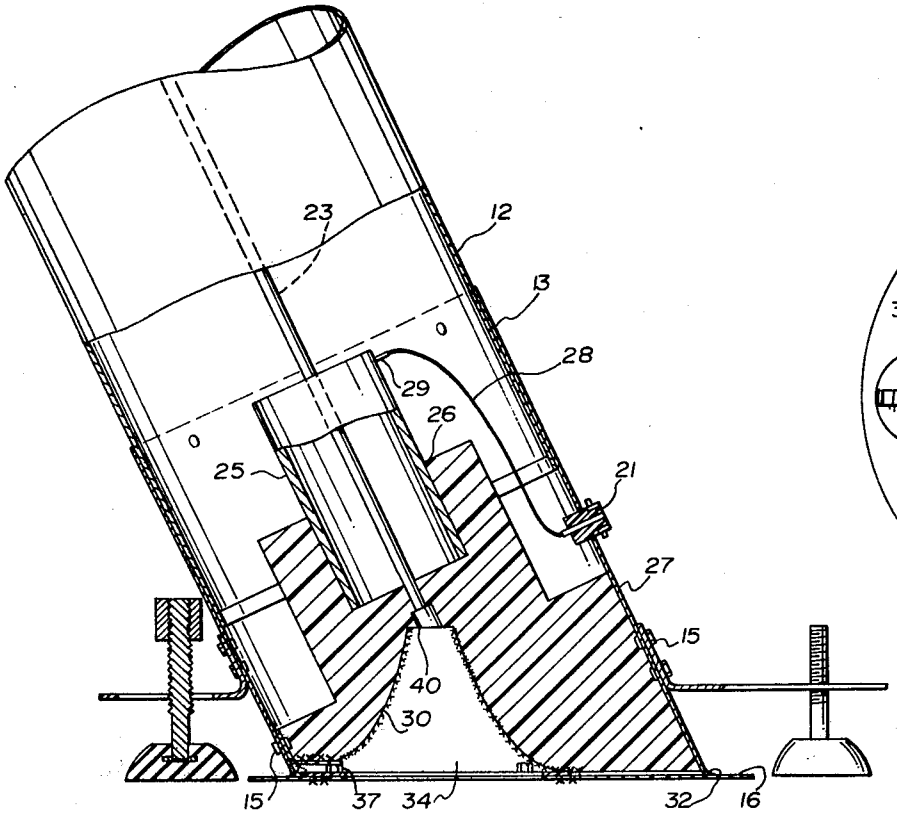
FIG. 2 is a longitudinal sectional view of the apparatus taken along the lines II—II of FIG. 1.

It will be noted from FIGS. 2 and 3 that the flange 16 comprises a peripheral portion of a conductive base disc 31 which is welded to a lowermost peripheral edge 32 of the shield 13. An opening 33 in the disc 31 is arranged in alignment with the cavity 34 of the plug 27 and is shaped to allow the coupler 10 to be placed over the antenna 11 and its base 38. A metal gasket 35 fits around the periphery of the opening 33 and is fastened to the disc 31 by means of rivets 15. The free ends of the copper mesh wall 30 are sandwiched between the gasket 35 and the disc 31 to ensure good electrical contact with the shield 13.

Grounding to the aircraft skin, which includes the surface 24, is achieved by means of three flexible contacts 36 that make electrical contact with screws 37 in the base 38. Thus, the only modification to an extant antenna installation on an aircraft is the use of different screws to replace those screws normally used to secure the antennas. It should be noted that the heads of the screws have been merely lengthened to make connection with the contacts 36. It will be seen in FIG. 3 that two adjacently placed contacts 36 are secured by rivets 15 to both the gasket 35 and the disc 31 whereas an opposite contact 36, which is at the narrow end of the cavity 34, is secured in a similar manner to a side wall of the shield 13 as shown in FIG. 2.

The coupler 10 provides low loss coupling of about 6.5 db between the signal generator and the antenna 11 over the General Aviation Frequency Band of 110 MHz to 130 MHz. Variations of the coupling loss on repeated coupler installations does not exceed 1 db because of the accuracy of fit of the sleeve 25 relative to the element 23 due to the aforenoted self-centering effect provided by the cavity 34. In addition, differential variations between two couplers used in the dual antenna installation does not exceed 1 db. Moreover, it will be noted that the couplers preserve the phase quadrature relationship between the two output signals within ±2° and that no physical contact with the element 23 is required. Finally, modification of the aircraft antenna installation is minimal since only the heads of the screws 37 are changed. As previously described, the heads are lengthened to assure good electrical contact with the flexible contacts 36. Furthermore, the coupler 10 provides adequate shielding from atmospheric noise and man-made interference together with shielding the test signal in order to prevent interfering with nearby receivers.

Rigid aluminum is recommended for the construction of the coupler 10 since this material results in a lightweight structure which is more readily held in position by means of the suction cups 17. Other alternatives may be used such as flexible or collapsible metal tubing to accommodate various antenna types and shapes. Moreover, a flexible shield would improve the portability of the coupler 10.

The dimensions of the shields 12 and 13 are not critical. For the embodiment described, rationalization between what was considered practical, and electrical characteristics, resulted in the choice of a nominally 6 inch diameter shield placed concentrically around the antenna 11. It was found that a metallic shield in such close proximity resulted in a serious degradation of the antenna V.S.W.R. However, it was also determined that the impedance of the antenna remained sufficiently stable with variation in concentricity of the shields 12 and 13 that objectives in respect of phase and amplitude stability could still be achieved. Increasing the diameter of the shields 12 and 13 within practical limits of from 8 inches to 12 inches produced no significant improvement. Effective electromagnetic shielding was obtained by providing a mechanical connection between the shield 13 and the aircraft skin by way of the flexible contacts 36 and the screws 37. It was also found necessary to close the top of the shield 12 with the screen 14 in order to optimize the shielding effect. Attenuation in excess of 60 db was measured using the configuration shown in the figures. However, if attenuation of about 35 db is adequate, the screen 14 can be omitted.

While the grounding embodiment shown in the figures and herein described is recommended, other means for grounding may be used such as a grounding ring or clips located on the aircraft. Conducting gaskets, finger stock or even conducting grease may be used as alernatives to provide electrical contact between the shield 13 and the surface 24. However, such alternatives generally require some modification of the airframe which may not be acceptable. In this event, therefore, the required contact with the surface 24 is best obtained by means of the contacts 36 and the screws 37 which requires minimum modification of an existing antenna installation.

The conductive sleeve 25 together with an antenna element 23 constitute coaxial transmission line coupling which was found to be an effective method of transferring electromagnetic energy to the antenna 11. The sleeve 25 is placed over the element 23 as may be seen in FIGS. 1 and 2 and the combination operates as a coaxial line system where the element 23 is the inner conductor and the sleeve 25 the outer conductor.

The described embodiment of the coupler 10 is for use with an antenna 11 approximately 22 inches in length. In order to obtain effective energy transfer with a coupling loss of about 6.5 db, the sleeve 25 was made 5 inches in length and 2 inches in diameter which resulted in a length ratio with the element 23 of 4.4:1. This ratio determined the minimum overall length of the coupler 10.

In the embodiment described, the coupler 10 has been made in several parts to facilitate assembly during manufacture. Other assembly methods may be used which would result in a modified structure of the coupler 10 but would not change the electrical characteristics. For example, the shields 12 and 13 could be formed as a single unit. A further modification could be introduced wherein the shields 12 and 13, together with the screen 14, are formed as a single unit through deep drawing techniques to which aluminum is well suited. This will result in a coupler 10 having a more simple configuration.

As regards the R.F. coupling means, other means may be employed such as loop coupling using a predetermined number of turns of wire in place of the sleeve 25.

Suction cups 17 have proven to be a satisfactory means for mounting the coupler 10. However, the invention is not restricted to suction cups and other forms of mounting are possible. For example, the suction cups 17 could be replaced with magnets which would be attracted to ferrous material placed in the aircraft frame. Alternatively, other mechanical means including recesses in the aircraft skin surface adapted to receive projecting studs from the shield 13 could be used. However, in either of these alternative modes of mounting, mechanical modifications of the aircraft airframe would be required.

The embodiment disclosed and illustrated has been described in an application for transferring electromagnetic energy from a signal generator to an antenna. However, the same embodiment may also be employed to receive electromagnetic energy from the antenna when testing the performance of a transmitter.

In light of the aforenoted variations in structure, which would be apparent to those skilled in the art having the benefit of the present disclosure, it should be understood that the invention is not limited to the embodiment illustrated and described but rather as defined in the appended claims.

What I claim is:

1. A shielded signal coupler for transferring electromagnetic energy between a signal circuit and an antenna upstanding from a ground-plane surface, the coupler comprising:

Shield means having electrically conductive walls defining a closed chamber, including end portions defining a first opening adapted to admit the antenna;

means for electrically connecting said walls adjacent the first opening with the surface;

coupling means disposed within the chamber in isolated relation with the walls and antenna and in coaxial, energy transferring relation with the antenna, said energy being shielded by an outer conductor of the coupling means and confined between the outer conductor and the antenna; and signal conduction means for communicating the energy between said circuit and the coupling means through a second opening in said walls.

2. A coupler as claimed in claim 1, further comprising solid dielectric means to isolate the coupling means from the walls and to retain the coupling means in said coaxial relation with the antenna.

3. A coupler as claimed in claim 2, further comprising means for mechanically securing the shield means to the surface in enclosing relation with the antenna.

4. A coupler as claimed in claim 3, wherein the coupling means comprises an electrically conductive sleeve disposed in coaxial relation with a longitudinal portion of the antenna.

5. A coupler as claimed in claim 4, wherein the shield means comprises a first metallic cylinder having a partly closed end that includes the first opening, and a fully open opposite end.

6. A coupler as claimed in claim 5, wherein the shield means further comprises a second metallic cylinder having a fully open end adapted to be secured within the open end of the first cylinder, and a closed opposite end.

7. A coupler as claimed in claim 6, wherein said end portions comprise metallic mesh conforming to a dielectric base of the antenna.

8. A coupler as claimed in claim 7, wherein the solid dielectric means is disposed upon said mesh around the first opening and includes a recessed portion at the free end of the plug adapted to securably receive one end of the sleeve in coaxial relation with the first opening.

9. A coupler as claimed in claim 8, wherein the signal conduction means comprises a feed-through coaxial connector disposed within the second opening and secured to the side walls of the first cylinder, and a metallic conductor connecting a center conductor of the connector to a tab portion of the sleeve.

10. A coupler as claimed in claim 9, wherein the means for mechanically securing the shield means comprises at least one suction cup mounted on the outside surface of the first cylinder and adapted to be held in suction relationship with said surface to hold the coupler in energy transferring relation with the antenna.

11. A coupler as claimed in claim 5, further comprising metallic mesh closing off said open opposite end.

12. A coupler as claimed in claim 10 wherein the solid dielectric means comprises a styrofoam plug.

* * * * *

UNITED STATES PATENT AND TRADEMARK OFFICE

CERTIFICATE OF CORRECTION

PATENT NO. : 4,134,119

DATED : January 9, 1979

INVENTOR(S) : Oscar A. Sandoz, et al

It is certified that error appears in the above-identified patent and that said Letters Patent are hereby corrected as shown below:

The assignee should read --Canada, Her Majesty the Queen in right of, as represented by the Minister of National Defence --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*